United States Patent [19]

Greverath

[11] Patent Number: 4,522,504

[45] Date of Patent: Jun. 11, 1985

[54] LINEAR IN-LINE MIXING SYSTEM

[75] Inventor: Peter H. Greverath, Berkley, Mich.

[73] Assignee: Pyles Division, Wixom, Mich.

[21] Appl. No.: 559,254

[22] Filed: Dec. 8, 1983

[51] Int. Cl.[3] ..... B01F 5/06

[52] U.S. Cl. ..... 366/339; 138/40; 138/42; 366/338

[58] Field of Search ..... 366/336–340, 366/176, 341; 138/38, 40, 42; 137/896; 48/180 R, 180 M, 180 B

[56] References Cited

U.S. PATENT DOCUMENTS

| | | | |
|---|---|---|---|
| 2,601,018 | 6/1952 | Heyl et al. | 259/4 |
| 3,203,371 | 8/1965 | Mosey | 107/31 |
| 3,263,928 | 8/1966 | Gusmer | 239/123 |
| 3,286,992 | 11/1966 | Armeniades et al. | 259/4 |
| 3,782,694 | 1/1974 | Shano | 259/4 |
| 4,183,682 | 1/1980 | Lieffers | 366/339 |

OTHER PUBLICATIONS

Kenics Corporation, "KTEK-12345678" by S. J. Chen, Ph.D., Jul. 1972.

Luwa Corporation, "Let Luwa Engineer Your Next Mixing System".

Chemical Engineering, "Motionless Inline Mixers Stir Up Broad Interest" by D. A. Pattison, May 19, 1969.

Liquid Control Corporation Bulletin No. PM 101.

*Primary Examiner*—Timothy F. Simone

*Attorney, Agent, or Firm*—Beaman & Beaman

[57] ABSTRACT

The invention pertains to a linear in-line mixing system wherein a plurality of tubular elements removably located within a conduit in end-to-end relationship define a passage through which materials to be mixed flow. The elements each contain a pair of helical vanes spiralled in opposite directions about the associated element's longitudinal axis, and engaging elements are interlocked to prevent relative rotation.

6 Claims, 7 Drawing Figures

LINEAR IN-LINE MIXING SYSTEM

BACKGROUND OF THE INVENTION

In-line mixing systems for fluids normally utilize baffles or partitions within a conduit to cause the fluid material to be agitated and kneaded as it passes through the conduit.

Commonly, in-line mixing systems are utilized in the mixing of epoxies, resins, foams and other compositions which set and harden, and it is important that such mixing systems be quickly purged and cleaned of the mixed material before setting occurs. Even with the practice of good cleaning and maintenance procedures, it is not uncommon for the material to harden within the mixing apparatus often necessitating discarding of the apparatus and replacement in view of the difficulty to clean. Various systems have been proposed for minimizing problems arising with respect to the cleaning and purging of in-line mixing systems, but present apparatus have not fully solved the problems.

It is an object of the invention to provide a linear in-line mixing system utilizing a plurality of disposable, low cost, mixing elements removably located within a conduit whereby the elements may be readily removed from the conduit even if the mixed material has hardened therein.

Another object of the invention is to provide a linear in-line mixing system wherein superior mixing of a fluid material flowing through a plurality of elements is achieved in a relatively short axial flow path, and the resistance to material flow is not excessively high.

An additional object of the invention is to provide a linear in-line mixing system utilizing a plurality of low cost, disposable mixing elements located in end-to-end abutting relationship within a conduit, each element including a passage having a set of helical vanes spiralling in opposite directions about the element's longitudinal axis.

Yet another object of the invention is to provide an in-line linear mixing system utilizing a plurality of disposable elements located within a conduit in abutting end-to-end relationship wherein the elements are interlocked to produce a desired orientation between adjacent elements and prevent relative rotational displacement.

In the practice of the invention a plurality of inexpensive, annular, molded, cylindrical elements are located in abutting end-to-end relationship within a conduit. The elements each include a passage, and the passages of adjacent elements are aligned with each other concentric to the conduit. Each element includes a pair of helical vanes, the vanes spiralling in opposite directions about the associated element's longitudinal axis. The vanes include linear leading and trailing edges disposed at right angles to the element axis wherein the edges aid in the mixing and agitation of material flowing therethrough, and the vanes within a common element are rotationally offset 90° with respect to each other.

Opposite ends of the elements include an axially extending recess and complementary projection wherein the projection of one element is received within the recess of the adjacent engaged element preventing relative rotational displacement of the elements and maintaing a predetermined rotational orientation therebetween.

The diameter of the elements is slightly less than the inner diameter of the conduits with which they are associated, whereby the elements may be easily removed from the associated conduit, and the elements are of such configuration as to cooperate with the end fittings of the associated conduit wherein the end fittings maintain the elements within the conduit during operation.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
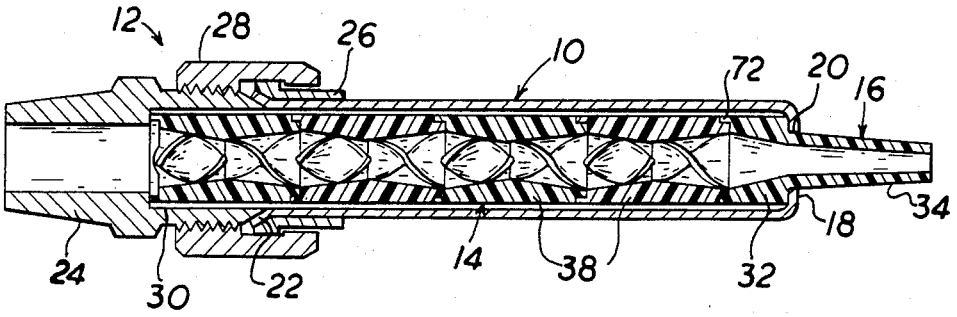
FIG. 1 is an elevational, diametrical, sectional view of a linear in-line mixing system in accord with the invention.

A typical assembly of a linear in-line mixing system in accord with the invention is shown in FIG. 1 wherein, basically, the system includes a cylindrical conduit 10 having an end fitting 12 removably attached thereto at one end, and a plurality of mixing elements 14 are axially aligned within the conduit and engage in end-to-end relationship wherein the material to be mixed may enter the conduit at fitting 12, be mixed as it flows through the elements 14, and leaves the mixing system through a nozzle 16. It is to be appreciated that the mixing system may also be utilized as a section in a conduit system wherein a fitting is located at each end of a conduit section and no nozzle is utilized in direct proximity to the mixing elements.

In the embodiment of FIG. 1, the conduit or tube 10 is usually formed of metal, and at the right end 18 is partially closed to define a central opening 20, and at the left end is flared at 22. The fitting 12 includes the threaded adapter 24 having a conical surface for sealingly engaging the conduit flare 22, and by means of compression sleeve 26 and compression nut 28 threaded upon adapter 24 the fitting is maintained upon the conduit in a releasable, yet liquid tight manner.

The adapter 24 includes an axial passage which includes the enlarged cylindrical portion 30 of a diameter substantially corresponding with the inner diameter of the conduit 10. The nozzle 16 is located at the right end of the conduit and includes a cylindrical body portion 32 having an annular abutment shoulder engaging the conduit end 18. The nozzle includes a conical neck 34 extending through the conduit opening whereby the mixed material may pass through the nozzle for dispensing from its open end.

Mixing within the conduit 10 is achieved by a plurality of mixing elements 14. The elements 14 are preferably formed of a synthetic plastic material such as nylon, or similar composition, which has a relatively high mechanical strength as to resist collapse, inexpensive, and readily moldable by injection molding. The elements 14 are identical in configuration and the number of elements used in a system may be varied depending upon the extent of mixing desired and the physical characteristics of the conduit 10 or other apparatus used in conjunction with the elements. Within the scope of the inventive concepts, the length and diameter of the elements may vary in accord with the requirements of the particular system.

The elements 14 include a generally cylindrical body 36 having a cylindrical outer surface 38, an axial passage 40, and ends 42 and 44.

Figure 3:
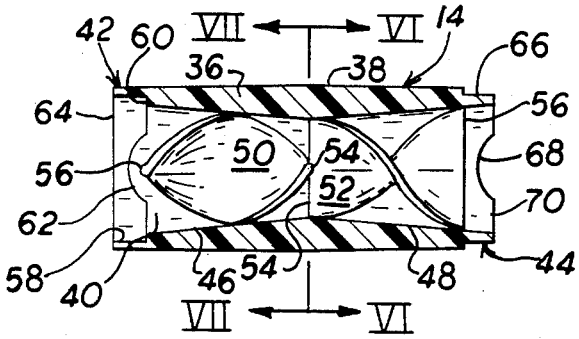
FIG. 3 is an enlarged, diametrical, sectional, elevational view of a mixing element in accord with the invention as taken along Section III—III of FIG. 5.
Figure 4:
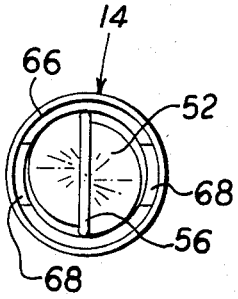
FIG. 4 is an end elevational view of the element of FIG. 3 as taken from the right end thereof.
Figure 7:
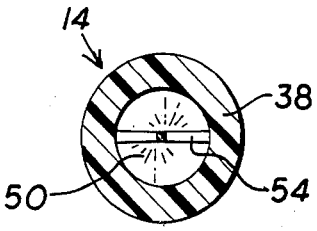
FIG. 7 is an elevational, sectional view as taken along Section VII—VII of FIG. 3.
Figure 6:
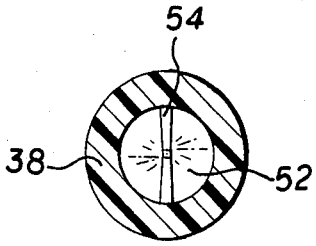
FIG. 6 is an elevational, sectional view as taken along Section VI—VI of FIG. 3.

As will be appreciated from FIG. 3, the passage 40 is of a varying cross sectional dimension such that the passage diameter is at a maximum adjacent the element ends, and at a minimum at the element center wherein the passage consists of a pair of conical sections 46 and 48, the central reduced passage portion somewhat restricting flow therethrough to accelerate the material movement at this central region.

Mixing means, in the form of a pair of mixing vanes constituting a set, are located within each element 14. A set consists of mixing vanes 50 and 52, and the vanes are homogeneously formed of the material of the body 36 during the molding of the associated element. Each vane is "twisted" through 180° throughout its length to define a helix, and the vanes are twisted in opposite directions, and each vane is axially defined by an inner linear edge 54 and an outer linear edge 56 which are diametrically related to the element passage and perpendicular to the element axis.

As will be appreciated from the drawings, the vane 50 is oriented 90° with respect to the vane 52 whereby the inner vane edges 54 engage at only a single central point, and the outer edges 56 of the vanes 50 and 52 are oriented at 90° to each other with respect to the element axis.

The helix angle of the vanes is approximately 45°, and this steep helical angle in conjunction with the additional mixing produced by the edges 54 and 56, and the agitation resulting from the variable cross sectional dimension of the passage 40 achieves a thorough mixing of material passing through a plurality of mixing elements 14.

The element ends 42 and 44 are formed to produce a sealed relationship to adjacent elements, and are also provided with orientation means to locate and maintain a predetermined rotational relationship between engaging elements with respect to the element's axis.

At element end 42 a cylindrical recess 58 is defined terminating in shoulder 60 which forms an annular ridge adjacent the passage 40. This ridge includes a pair of diametrically positioned convex tongues or projections 62 which extend in an axial direction from the ridge, but terminate short of the element edge 64.

At the element end 44, the element is provided with a reduced cylindrical diameter at 66 of a diameter substantially equal to the diameter of recess 58, and of an axial dimension substantially corresponding to that of recess 58. The element end 44 is provided with a concave groove or recess 68 of a configuration corresponding to the projection 62, a pair of recesses 68 being defined at end 44 intersecting the edge 70 positioned at diametrical locations and angularly oriented in the same manner as the projections 62.

Figure 2:
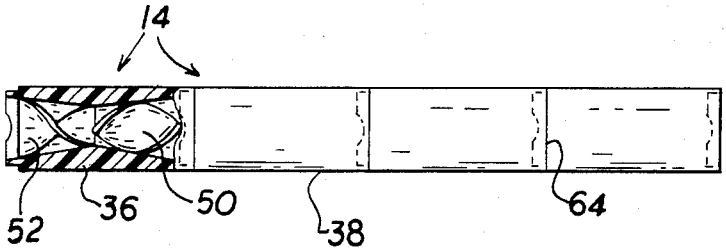
FIG. 2 is an elevational view, partially in section, illustrating a plurality of mixing elements interconnected in end-to-end relationship.
Figure 5:
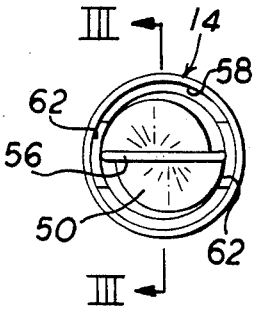
FIG. 5 is an end elevational view of the mixing element as taken from the left of FIG. 3.

Accordingly, the configuration of the ends of the elements 14 is such that a plurality of elements may be interconnected in an axially aligned "stacked" or abutting relationship wherein end 44 enters end 42 of the adjacent element. The reduced diameter 66 telescopingly enters the adjacent element cylindrical recess 58 providing a sealed relationship, and as the associated projection 62 will enter the aligned recess 68 adjacent elements are keyed or locked together relative to rotation about the axis of the aligned elements. FIG. 2 illustrates a typical "stack" of four elements 14 as used with the apparatus of FIG. 1.

In a mixing system such as shown in FIG. 1, initially, the adapter 24 is removed from the conduit 10 by disassembly of the compression nut 28. Thereupon, after the nozzle 16 has been inserted into the conduit, an assembled stack of four elements 14 is inserted into the conduit as shown in FIG. 1. Preferably, the nozzle 16 includes an annular recess and lip 72 which cooperates with the adjacent element diameter 66, and the length of the adapter diameter 24 is such as to impose an axial compressive force upon the stack of elements upon the fitting being completely assembled to the conduit. Thus assembled, the elements 14 are firmly mechanically oriented within the cnoduit 10 intermediate the fitting 12 and the nozzle 16.

Attachment of the fitting 12 to a hose or conduit through which the material to be mixed flows causes the material to enter the adapter and flow through the elements 14 for ejection and distribution through the nozzle 16. The axial movement of the material through the four elements 14 causes the material to be alternately twisted and kneaded in opposite directions through each element due to the opposite hand orientation of the vane sets, and mixing is also aided by the encounter of the material with the "upstream" edges of the vanes, as well as the varying velocities produced within the elements due to the differential cross section of the passage 40.

The mixing system of the invention is excellent for mixing resins, catalysts with resins, foam, multi-component compositions, and the like, and many of these compositions will harden in a relatively short duration. While the apparatus of the invention readily lends itself to cleaning by flowing a cleaning fluid or solvent through the system, in the event that the material being mixed hardens within the system it is possible to salvage all of the components except the low cost disposable mixing elements 14.

If the composition being mixed hardens within the apparatus of FIG. 1, removal of the compression nut 28 permits the adapter 24 to be disassembled from the conduit 10, and as the mixture has not engaged the conduit itself, removal of the adapter will also draw with it the elements 14 and nozzle 16 from the conduit.

The elements 14 and nozzle 16 will be maintained in an interconnected relationship by the hardened material therein, but it is usually possible to readily remove the element 14 from the adapter diameter 30 and the elements and nozzle may be discarded. It only remains then to clean the adapter passage, and as mixing has not occurred with the adapter, the chemical reaction occurring therein is minor permitting easy cleaning thereof by solvents.

By the insertion of a new nozzle 16 and a stack of elements 14 into the conduit 10 the apparatus may again be restored to an operable condition and considerable time saving and cost efficiencies are experienced with the practice of the invention as compared to the usual time consuming cleaning procedures required with other types of linear mixing devices.

It is to be appreciated that the integral formation of the vanes 50 and 52 relative to the element's body 36 prevents the vanes from axially shifting within the elements, as often occurs with mixing systems wherein internal vanes and baffles are assembled within cylindrical sleeves. Also, by separating the vane sets in the disclosed manner, axial forces upon the vanes are not cumulative and collapse and destruction of the mixing components is not as likely in the practice of the invention as with prior art in-line linear mixing systems.

It is appreciated that various modifications to the inventive concepts may be apparent to those skilled in the art without departing from the spirit and scope of the invention.

I claim:

1. In-line mixing apparatus for mixing material flowing through a conduit, comprising, in combination, at least a pair of tubular elements each having a passage, a first end and a second end, orientation means defined upon said elements' first and second ends rotatably orientating engaging elements upon a pair of said elements being oriented in end-to-end abutting relationship with a first end engaging a second end, mixing means within said elements' passages agitating material flowing therethrough to intermix such material comprising helical vanes within said elements' passages, said vanes within each element comprising first and second axially spaced vanes, the helix of said first vane being in the opposite direction of said second vane, said elements and vanes being homogeneously molded of a synthetic plastic material.

2. In mixing apparatus as in claim 1, said orientation means comprising an axially extending projection defined on said elements first end and a complementary shaped axially extended recess defined in said elements second end.

3. In mixing apparatus as in claim 1, each vane axially terminating in a substantially linear edge diametrically oriented to the associated element passage, each vane including an outer edge adjacent an element end and an inner edge axially centrally located between each element's ends, said inner edges of an element being rotatably oriented 90° with respect to each other about the axis of the associated element, said outer edges of an element being rotatably oriented 90° with respect to each other about the axis of the associated element, and said orientation means being related to said outer edges whereby abutment of adjacent axially aligned elements orients the opposed outer edges 90° with respect to each other about the axis of the adjacent elements.

4. In mixing apparatus as in claim 1, each tubular element having a central region equally located between said first and second ends, and the passage of each element comprising a pair of conical surfaces each having a maximum diameter adjacent an end and a minimum diameter at the associated element central region whereby the minimum diameter of said passage of each element occurs at said central region thereby accelerating the movement of material being agitated at said elements' central regions, said first and second vanes each being located intermediate an end of said element and its central region.

5. As an article of manufacture, a disposable mixing element adapted to be inserted into a conduit comprising a tubular body of synthetic plastic material having an axial passage and first and second ends, first and second axially spaced helical vanes within said passage, the helix of said first vane being in the opposite direction of said second vane, and an axially extending projection defined on said body first end and a complementary shaped recess defined on said body second end, said vanes being homogeneously formed of the material of said body.

6. In an article of manufacture as in claim 5, said tubular body axial passage having a central region, and said passage being defined by a pair of conical surfaces converging from the ends of said body toward said central region defining the axial passage minimum diameter at said central region, a vane being located within each conical portion of said passage.

* * * * *